United States Patent [19]

Zale

[11] 4,018,016

[45] Apr. 19, 1977

[54] WAITING STATION FOR BUSES

[76] Inventor: Theodore R. Zale, 160 E.65th St., New York, N.Y. 10021

[22] Filed: Feb. 6, 1976

[21] Appl. No.: 655,728

[52] U.S. Cl. ..... 52/36; 52/200; 52/263; 52/656; 52/690; 403/230; 403/353

[51] Int. Cl.[2] ..... E04H 1/12

[58] Field of Search ..... 52/239, 263, 79, 200, 52/656, 36, 690; 5/282 R; 403/230, 231, 353, 406, 264

[56] References Cited

UNITED STATES PATENTS

| | | | |
|---|---|---|---|
| 1,178,338 | 4/1916 | Niernsee | 403/353 X |
| 2,237,385 | 4/1941 | Anderson | 52/36 X |
| 2,328,928 | 9/1943 | Sherron | 52/239 X |
| 3,107,864 | 10/1963 | Kinnear et al. | 52/200 X |
| 3,136,530 | 6/1964 | Case | 403/230 X |
| 3,762,109 | 10/1973 | Cohen | 52/79 |

FOREIGN PATENTS OR APPLICATIONS

| | | | |
|---|---|---|---|
| 1,539,100 | 8/1968 | France | 52/36 |
| 410,372 | 10/1966 | Switzerland | 52/90 |
| 425,010 | 3/1935 | United Kingdom | 403/230 |
| 741,018 | 11/1955 | United Kingdom | 52/263 |

*Primary Examiner*—Alfred C. Perham
*Attorney, Agent, or Firm*—John J. Hart

[57] ABSTRACT

The waiting station comprises at least one wall structure composed of vertical columns, horizontal beams and a mullion, each of said members being contituted of aluminum tubing. Such tubular members are provided with pairs of cooperative interlatching elements, each of such pairs comprising a flanged latch plate that is wholly contained within the opening at one or both ends of a tubular member so that the outer surface of such latch plate is flush with the terminal end of the tubular member, and a Z-shaped catch having one end portion secured to the exterior surface of the wall of a tubular member and having its their end portion interlatchable with the latch plate. In such interlatched condition the two interlatching elements are entirely concealed by the connected end of one of the tubular members and the wall of the other connected tubular member. The wall structure is constructed in a modular fashion, each module comprising two vertical columns, an upper and lower horizontal beam spanning the space between the two columns at places spaced from the terminal ends of the vertical columns, and a vertical mullion spanning the space between the centers of the horizontal beams. The aforesaid assemblage of interlatched tubular members are locked together by two window units that fill in the two spaces formed by the tubular members of each module, the sides of the frame of each window unit being securely fastened to the enclosing tubular member portions. If the waiting station comprises a three sided wall structure, the back and side modules of such structure are further locked together by a rectangular roof structure, the beams of which are connected together and are seated on and connected to the upper projecting ends of the vertical columns of the structure by the aforesaid cooperative interlatching elements.

5 Claims, 13 Drawing Figures

WAITING STATION FOR BUSES

The Invention

This invention relates to shelters for open air locations such as parks and bus stops.

Bus shelters usually have a rear wall and a roof covering and may additionally have side walls connected to the ends of the rear wall. In the past these shelters have been constructed of wood and stone, but more recently aluminum beams and columns have been used in their construction because the latter provide certain obvious advantages over the wood and stone constructions. However, the aluminum beam and column types of shelters so far designed have certain inherent faults which render their use not completely satisfactory.

It is the principal purpose of the present invention to provide an improved bus shelter in which such faults are eliminated. Thus, one of the objects of the invention is to provide a beam and column shelter construction which can be shipped and handled manually in readily manageable sections and which may be assembled in situ with the use of hand tools.

A further object of the invention is to provide a beam and column shelter construction of the indicated type that in its final form can be locked together through the placement of window units and/or the roof assembly, and when locked together will be substantially tamper proof, yet can be easily disassembled and relocated at another site.

Other objects of the invention, as well as the advantages and features of novelty thereof, will appear from the following description when read in connection with the accompanying drawings, in which FIG. 1 is a front, perspective view of a bus shelter constructed in accordance with the invention;

Figure 1:
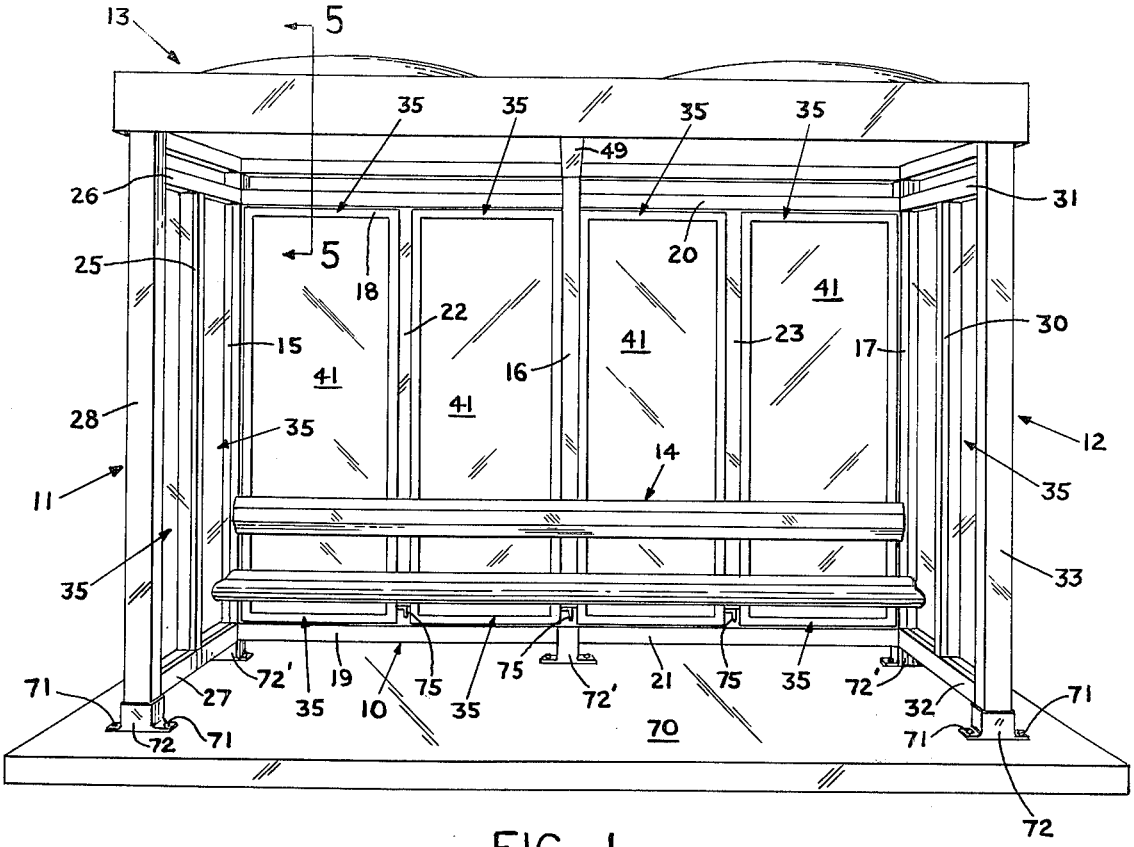
Figure 8:
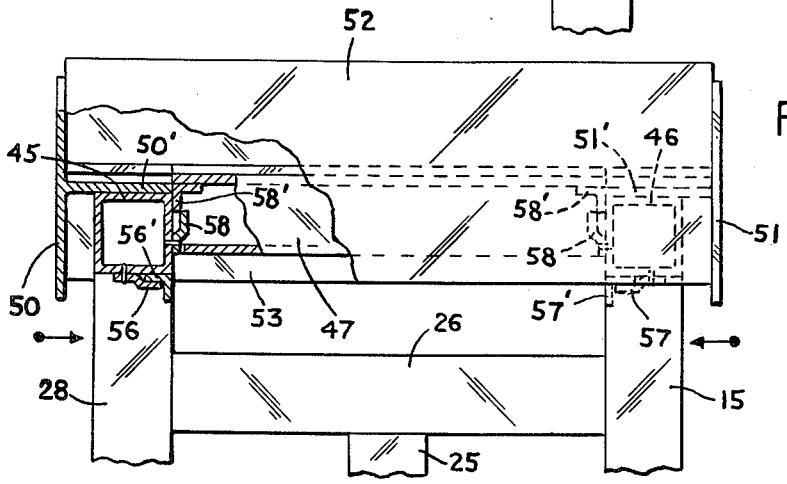
Figure 9:
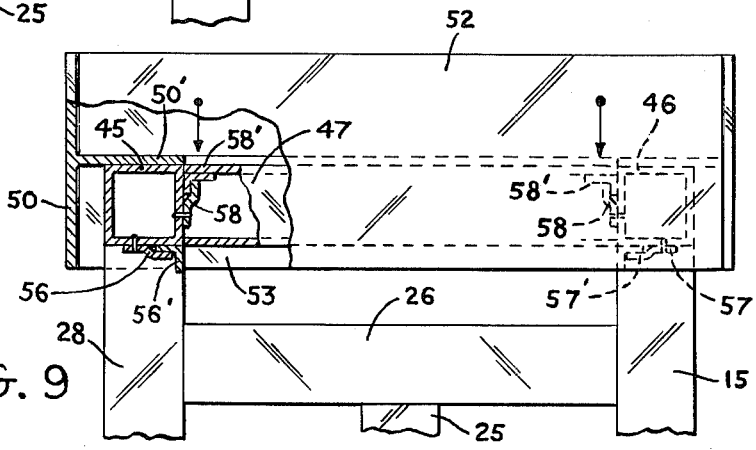

As is shown in FIG. 1 of the drawings, the bus shelter of this invention is composed of a back frame 10, two side frames 11 and 12, a roof assembly 13, and a seat section 14. The back and side frames of the bus shelter are made of tubular aluminum members formed to provide a modular construction. The basic components of each module in the back and side assemblies consist of two vertical posts or columns, upper and lower horizontal beams connected to the ends of said posts, and a mullion centrally located between the posts and connected at its ends to the horizontal beams. In the back frame 10 one of the columns or posts is common to the two modules forming the same. As is shown more clearly in FIG. 2 of the drawings, the two modules forming the back frame 10 are composed of three vertical posts 15, 16 and 17; post 16 being common to both modules. Each module further includes two horizontal beams; the beams associated with the posts 15, 16 being designated 18 and 19, and the beams associated with the posts 16,17 being designated 20 and 21. A central mullion 22 is located between the beams 18, 19 and a central mullion 23 is located between the beams 20, 21, The members 15–23 forming the two back frame modules are constituted of lengths of square-shaped aluminum tubing provided with cooperative interlatching elements that enable such members to be connected together without the use of tools and which are entirely concealed in the assembled condition of such members. Each cooperative pair of interlatching elements comprise a flanged latch plate which is wholly contained within the opening at one or both ends of a beam or post. The flange of the latch plate is secured in any suitable fashion to the interior surface of one of the walls of a beam or post so that the outer surface of the latch plate is flush with the terminal end of such beam or post. The latch plate is rectangular in shape and has a width equal to one dimension of the beam or post opening and a length less than one half the other dimension of such opening so that the latch plate has a free edge spaced substantially from the inside surface of the fourth wall of the beam or post. Each pair of interlatching elements further comprise a Z-shaped catch having one end portion secured to the exterior surface of a beam or post wall, the other end portion of the plate-like form being spaced in parallel relation to such exterior surface. The other end plate portion of the catch is dimensioned to enable it to enter the portion of the opening left remaining in the end of a beam or post by a latch plate and to be interlatched with such latch plate. As is shown in FIGS. 8 and 9 of the drawings with respect to the catch 58 on the beam 45 and the latch plate 58' on the beam 47, the two beams are moved relative to one another so that the latching plate portion of the catch 58 enters the opening in the associated end of the beam 47 and until such beam end engages the exterior surface of the wall of the beam 45 on which the catch is mounted. The latch plate 58' will then be in position to interlatch with the catch 58. The two beams are then moved relative to each other in a transverse direction to cause such interlatchment as shown in FIG. 9 of the drawings. It is to be noted in FIG. 9 that when the interlatchment is completed, the interlatched catch 58 and plate 58' will be entirely concealed by the end of the beam 47 and the wall of beam 45 on which the catch is mounted.

The assembly of the back frame members 15–23 may be done by first connecting the latch plates 22', 22' provided wholly within the openings at the ends of the mullion 22, to the catches 18', 19' provided on the inner sides of the beams 18, 19, respectively. The latching end of the plates 22', 22' as has been described, are flush with the terminal ends of the mullion 22 so that when such plates are interlocked with the latching portions of the Z-shaped catches 18', 19', the terminal ends of the mullion 22 will be abutting the inner sides of the beams 18, 19 and the interlocked elements 18', 19' and 22' will be entirely concealed (note FIG. 1). In a similar fashion the latch plates 18'' and 19'' within the openings at one end of the beams 18 and 19, respectively, are first interlocked with the Z-shaped catches 15', 15' on the ends of the inner side wall of the post 15, and then the latch plates 18'' and 19'' within the openings at the other end of the beams 18 and 19, respectively, are interlocked with the Z-shaped catches 16', 16' on the ends of one side wall of the post 16. This completes the assembly of the first back frame module.

The second back frame module is assembled and connected to the first back module by repeating the aforesaid procedure, i.e., by first interlocking the latch plates 23', 23' provided wholly within the openings at the ends of the mullion 23, to the catches 20', 21' provided on the opposed sides of the beams 20, 21 respectively; then interlocking the latch plates 20'', 21'' within the openings at one end of the beams 20 and 21, respectively, with the Z-shaped catches 16'', 16'' on the ends of the other side walls of the post 16; and finally interlocking the latch plates 20'', 21'' within the openings at the other end of the beams 20 and 21, respectively, with the Z-shaped catches 17',17' on the ends of the inner side wall of the post 17.

Figure 2:
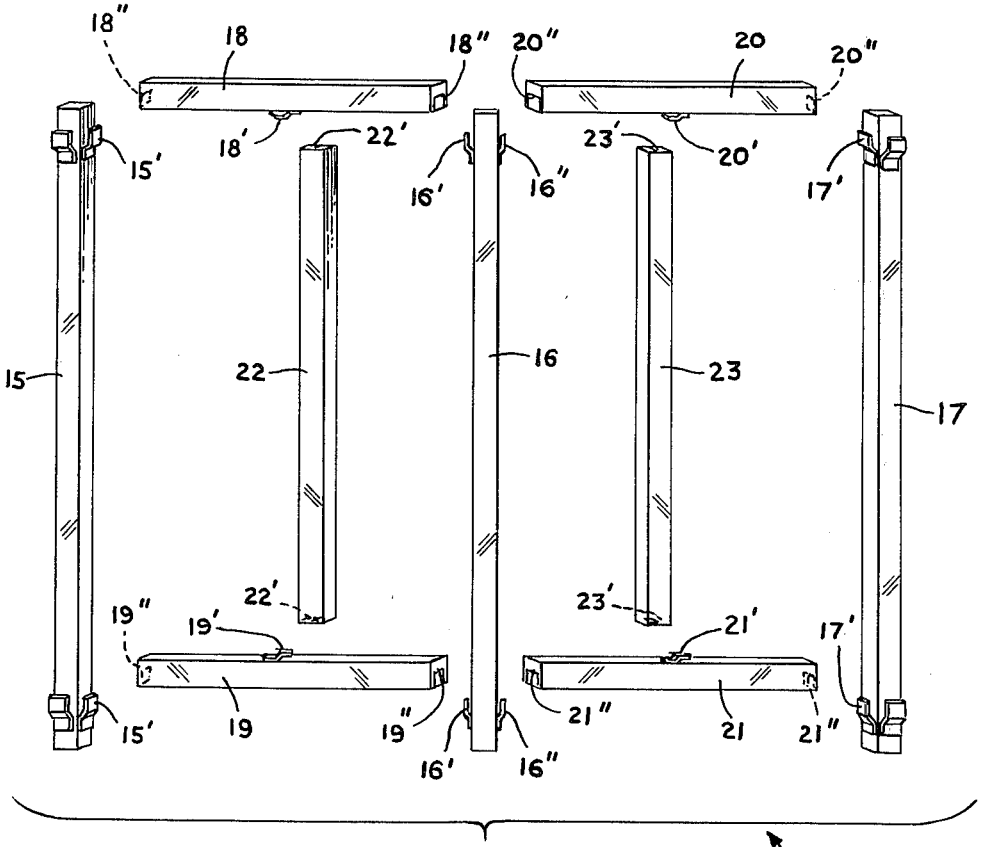
FIG. 2 is an exploded front elevational view, showing in perspective the individual beams and columns embodied in the back frame of the bus shelter.
Figure 3:
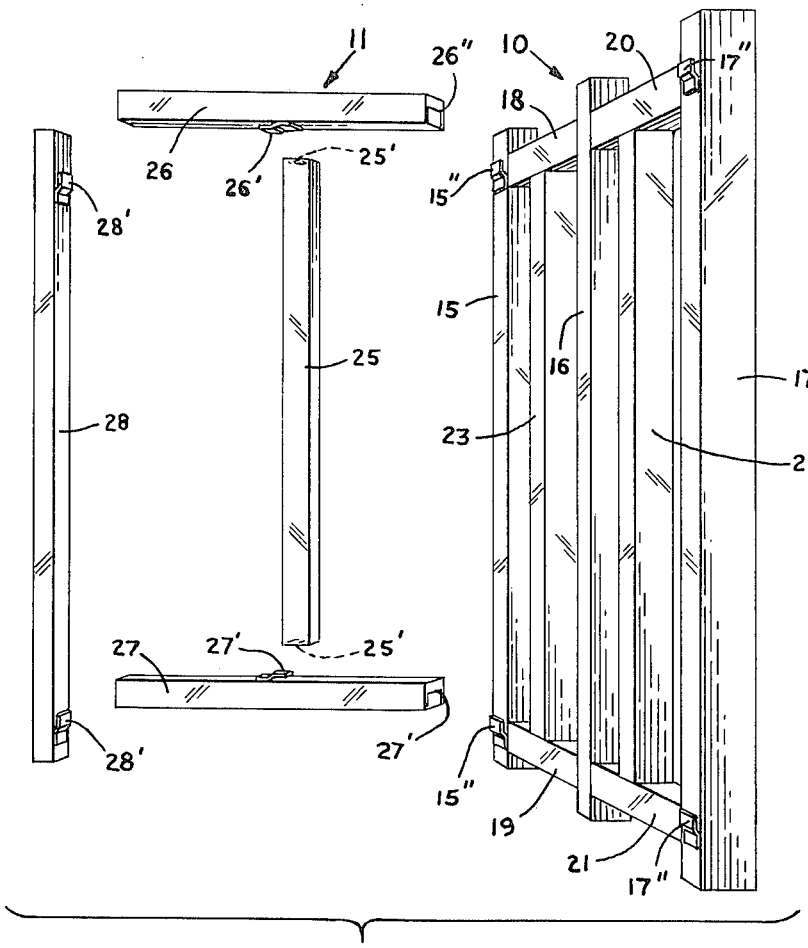
FIG. 3 is a perspective view showing the back frame components assembled and the individual beams and columns utilized in the formation of the left side frame of the shelter; as viewed in FIG. 1 of the drawings.

It will be noted from a comparison of FIGS. 2 and 3 of the drawings, that when the members 15–23 are assembled in the manner aforesaid with the sets of locking elements 15'–18'', 18''–16', 16''–20'' and 20''–17' interlocked in the manner previously indicated in connection with the showing of FIG. 9 of the drawings, the upper ends of the posts 15, 16 and 17 project above the horizontal beams 18 and 20 a distance substantially equal to the distance between the upper free edges of the top catches 15', 16' and 17' and the upper terminal ends of the posts 15, 16 and 17, respectively, and approximating the transverse dimension of such beams 18 and 20. The roof assembly 13 will be mounted on such projecting upper post ends in a manner to be hereinafter explained. Also, in each assembly, the lower ends of the posts 15, 16 and 17, project below the horizontal beams 19 and 21 a distance substantially equal to the distance between the bottom edges of the lower attached portions of the bottom clips 15', 16' and 17' and to the lower terminal ends of the posts 15, 16 and 17, respectively, and approximating the transverse dimension of the beams 19 and 21. Anchor flanges 72' (in FIG. 1) are attached to such lower projecting post ends in the installation of the bus shelter at its intended site.

Each of the modules forming the side frames 11 and 12 have a post that is common to one of the modules in the back frame 10. Thus, the back frame post 15 forms part of the module constituting the left side frame 11, as viewed in FIG. 1 of the drawings, and the back frame post 17 forms part of the module constituting the right side frame 12 as viewed in such FIG. 1. In assembling the modules forming the side frames 11 and 12, the same procedure previously described in connection with the assemblage of each of the back frame modules is followed. Thus, with respect to the left side frame 11 shown in FIG. 2 of the drawings, the latch plates 25', 15' provided wholly within the openings at the ends of the mullion 25 are latched with the latching plates of the catches 26', 27' provided on the opposed sides of the beams 26, 27, respectively; then the latch plates 26'', 27'' within the openings at one end of the beams 26 and 27, respectively, are latched with the plates of the catches 28',28' provided on the ends of the back wall of the post 28; and finally interlocking the latch plates 26'', 27'' within the openings at the other end of the beams 26 and 27, respectively, with the latching plates of the catches 15'', 15'' on the ends of the front wall of the post 15.

The module forming the side frame 12 is similar in construction to the module forming the side frame 11 and the mullion 30, beams 31 and 32, and the posts 17 and 33 constituting the frame 12 are assembled in exactly the same manner as were the corresponding parts in the frame 11. When the side frames 11 and 12 are thus assembled with the back frame 10, the upper and lower ends of the posts 28 and 33 thereof will project to the same extent and to the same end as the previously referred to upper and lower projecting ends of the posts 15, 16 and 17.

Figure 4:
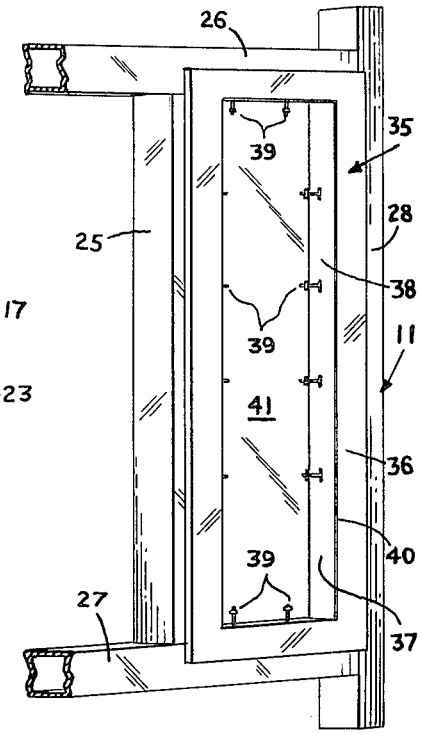
FIG. 4 is a perspective view looking from the left, as viewed in FIG. 1, at the outer end of the left side frame of the shelter in an incompleted form.

The said members of the thus described assemblage of side and back modules are locked together by window units designated generally in FIGS. 1 and 4 of the drawings by the reference numeral 35. As is shown more clearly in FIG. 4, each window unit is composed of a vertical closed rectangular frame section 36 having inner peripheral dimensions approximating the area of one of the two openings in each module defined by the mullion, beams and parts thereof. In FIG. 4 of the drawings, a window unit 35 is shown placed in the opening 37 defined by the mullion 25, beams 26, 27 and post 28 of the side frame 11. As is also indicated in such figure, each window unit 35 is mounted on the shelter from the outside so that the frame 36 thereof overlies the outer side walls of the side frame members 25–28. The sides of the window frame 36 have a width less than one-half the width of the side frame members 25–28 so that adjoining window units 35 can be mounted in adjacent openings 37 of the modules. Connected to the inner periphery of the vertical frame 36 of each window unit is an inwardly projecting, closed rectangular frame section 38 which is inserted into the opening 37 of the left side frame 11 and is in engagement with the opposed walls of the side frame members 25–28 defining such opening 37. The window frame section 38 is attached to such opposed walls of the side frame members 25–28 by either rivets or tamper proof screws designated 39 in FIG. 4. It will be observed that since both the two window units 35 in each module are locked to the beams which extend throughout each module, and the window units 35 in adjacent modules are locked to posts common to such adjacent modules, the aforesaid members of all of the modules forming the back and sides of the shelter are locked together by the window units. The two sections 36, 38 of each window unit 35 may be formed of a single piece of aluminum to provide maximum rigidity and to render them tamper proof. Each such window unit is formed with the usual seat 40 for receiving a pane of glass 41.

Figure 5:
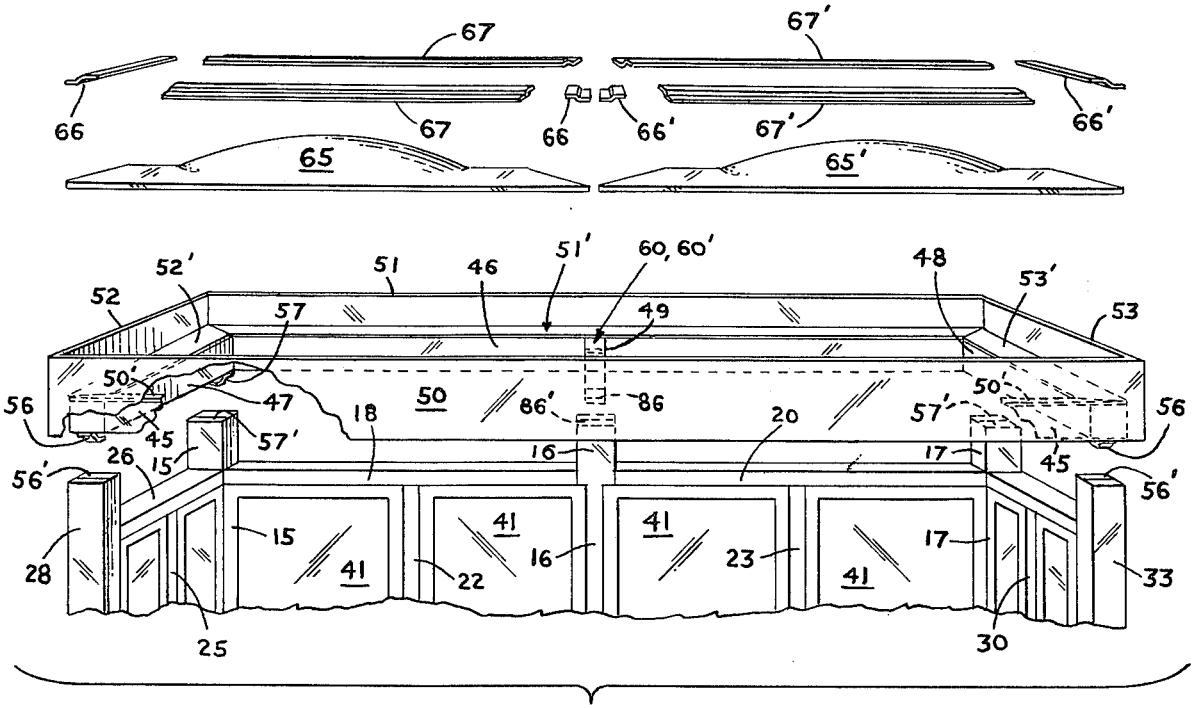
FIG. 5 is an exploded perspective view showing the parts embodied in the construction of the roof assembly and the manner in which such assembly is related to the top of the shelter.
Figure 6:
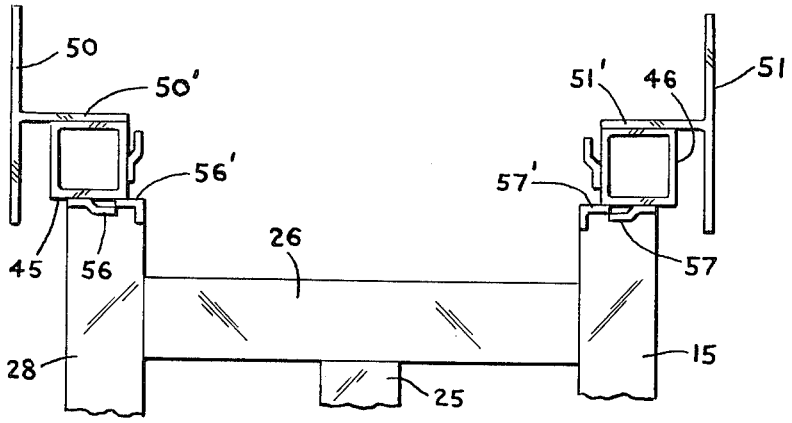
FIG. 6 is a side elevational view of the upper portion of the left side frame and showing the initial step of assembling horizontal beams and fascia of the roof section on the columns of the back and side frames.

The roof section 13 further locks the members of the aforesaid back and side modules together through its connections with the upper ends of the posts 15, 16, 17, 28 and 33 of such modules. As is shown in FIGS. 1 and 5–9 of the drawings, the roof section 13 is composed of a front beam 45, a rear beam 46, side beams 47 and 48, and a center transverse beam 49. The roof beams 45–48 support a fascia constituted of four sections 50–53 which form a horizontal rectangular band around the base of the roof section and enclose the beams 45–48 and the upper ends of the posts on which such beams are mounted. The fascia sections 50–53 are secured to the beams 45–48, respectively, by horizontal bracket plates 50'–53', respectively, which rest upon and are riveted to the upper walls of the beams 45–48, and which are connected along their outer side edges to the inner surfaces of the fascia sections intermediate the top and bottom edges of such inner surfaces. As shown more clearly in FIG. 5 of the drawings, the ends of the bracket plates 50'–53' are mitered to enable the fascia sections to form a closed rectangle on the beams 45–48, The beams 45–49 and the fascia sections 50–53 are assembled on the posts 15, 16, 17, 28 and 33 in the manner illustrated in FIGS. 6–9 of the drawings. Initially the front horizontal beam 45 is seated on the upper ends of the side end posts 28 and 33 with its associated fascia section 50 facing outwardly and spanning the space between such end posts. The horizontal beam 45 is so positioned on the posts 28 and 33 that the plate portions of the catches 56, 56 provided on the ends of the bottom wall of such beam just engage with the latch plates 56', 56' provided wholly within the openings at the tops of the posts 28 and 33. In a similar manner the rear horizontal beam 46 carrying the rear fascia section 51 is partially seated on the upper ends of the corner posts 15 and 17 so that the plate portions of the catches 57, 57 provided on the ends of the bottom wall of such beam just engage with the latch plates 57', 57' provided wholly within the openings at the tops of the posts 15 and 17. This initial positioning of the horizontal beams 45 and 46 and their associated fascia sections 50, 51, respectively, is illustrated in FIG. 6 of the drawings.

Figure 7:
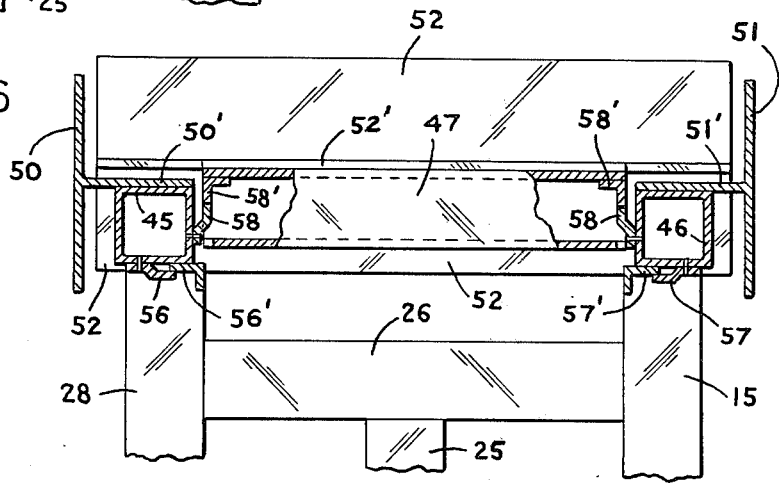
FIGS. 7–9 are views similar to FIG. 6 and illustrate the several steps taken in completing the assembly of the roof horizontal beams and fascia.

The side beams 47, 48 and the center transverse beam 49 are next partially positioned on the assembly. As is shown in FIG. 7 of the drawings, the side beam 47 is placed above the side beam 26 so that the latch plates 58', 58' provided wholly within the openings at the ends of the beam 47 rest on the plate portions of the catches 58, 58 provided at one end of the inner opposed walls of the beams 45,46. In this position of the parts the fascia section 52 carried by the beam 47 will be raised and positioned between the fascia sections 50, 51, as illustrated. In a similar fashion the side beam 48, together with its associted fascia section 53 will be positioned so that the latch plates 59', 59' (FIG. 5) provided wholly within the openings at the ends of the beam 48 rest on the plate portions of the catches 59, 59 provided at the other end of the inner opposed walls of the beams 45, 46 So likewise center beam 49 will be positioned so that the latch plates 60', 60' (FIG. 5) provided wholly within the openings at the ends of the beam 49 rest on the plate portions of catches 60, 60 provided on the central portions of the inner opposed walls of the two beams 45, 46.

The next step in the assembly of such roof parts is to slide the front and rear beams 45, 46, respectively, into place on the posts supporting them so that the plate portions of the catches 58, 59 and 60 on such front and rear beams will move into position to be latched with the latch plates 58', 59' and 60', respectively, on the beams 47, 48 and 49 respectively, in the manner shown in FIG. 8 of the drawings with respect to the latch plates 58' and catches 58. The side beams 47, 48 and the center beam 49 are then pushed downwardly so that the latch plates 58', 59' and 60' will interlatch with the catches 58, 59 and 60, respectively, in the manner shown with respect to the latch plates 58' and catches 58 in FIG. 9 of the drawings. When this has been accomplished the roof beams 45–49 will be interlocked with the tops of the posts 15, 16, 17, 28 and 33, and the fascia sections will be properly assembled in the manner indicated in FIG. 5 of the drawings. The assembly of the roof section 13 is completed by seating two roof bubbles 65, 65' of plastic material in aligned relation on the bracket plates 50'–53' and securing them in position thereon by fastening bars. As shown in FIG. 5 of the drawings, the fastening bars are eight in number and comprise two end bars 66, 66 and two side bars 67, 67 for securing the bubble 65 in place, and two end bars 66', 66' and two side bars 67', 67' for fastening the bubble 65' to the assembly. Each of the fastening bars are Z-shaped in cross-section in the manner of the catches previously described. The outer, lower longitudinal section of each fastening bar is secured by screws to the outer fascia secured edge portions of the bracket plates 50'–53'. The inner, raised longitudinal sections of said fastening bars overlie and securely clamp in position associated edge portions of the bubbles to the bracket plates and the central beam 49.

It will be understood from the foregoing, that the shelter of this invention may be shipped and handled in easily manageable parts and that it is assembled en situ at any desired location in the manner above described. At the site at which the shelter is to be assembled, a concrete platform 70 is first laid. The back frame 10, the side frames 11 and 12 and the roof structure 13 are then assembled on the concrete platform 70 in the manner previously described.

The shelter is securely anchored to the platform 70 by anchor flanges 72, 72' placed on the lower projecting ends of the posts 28, 15, 16, 17 and 33 and bolted to the concrete of such platform. As is shown in FIG. 1 of the drawings the anchor flanges 72 placed on the lower projecting ends of the posts 28 and 33 are double flanged, while the anchor flanges 72' provided on the lower projecting ends of the posts 15, 16 and 17 are single flanged. After the anchor flanges 72 and 72' are placed on the said post ends holes are drilled into the concrete platform through openings in the flanges of such members. Stud bolts 71 are then driven into the concrete through such flange openings and drilled holes and tightened to fasten the anchor flanges to the platform. The anchor flanges 72, 72' may be secured to the lower ends of the posts 28–33 and 15, 16, 17, respectively, by rivets or other suitable fastening members.

It will be noted that in the assembly of the aforesaid shelter parts, by reason of the construction of the latching elements thereon, all of the columns and beams are connected together without the requirement of any tools and that when once so connected such latching elements are concealed and protected against vandalism by the enclosing portions of the beams and columns. This construction also makes it possible to readily disassemble the shelter if it is desired to relocate it at another place. As has been previously mentioned, the readily disassembled beams and posts are locked together in their final form by the placement and attachment of the window sections and of the roof assembly. These parts may be rendered vandal-proof either with rivets or tamper-proof screws of types that can be subsequently removed without damage to the shelter parts secured thereby in the event such parts are to be used at a different location.

Figure 10:
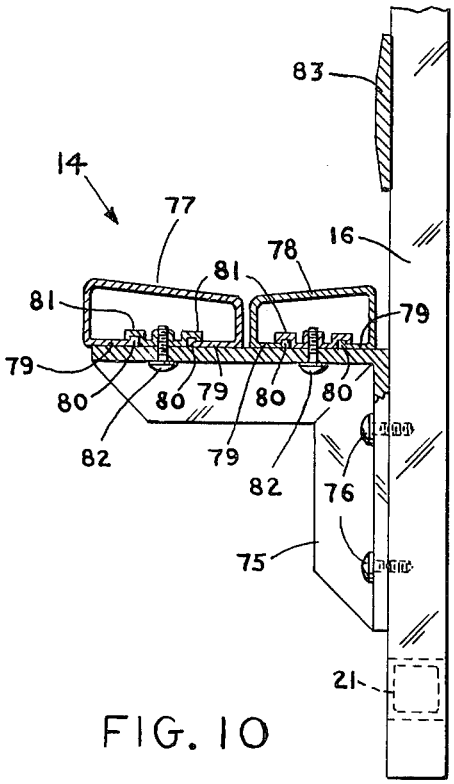
FIG. 10 is a vertical sectional view of the seat section provided in the bus shelter.

When the shelter has been assembled in the manner described, it is preferably provided with seating capable of withstanding adverse weather conditions and vandalism. As is shown in FIGS. 1 and 10 of the drawings, the seat section 14 comprises three right - angled brace members 75 secured to the post 16 and the mullions 22, 23 in the region of the bottoms of the window frames 35. The vertical legs of the braces 75 are secured by rivets 76 to the post 16 and mullions 22,23. Resting on the horizontal arms of the braces 75 are two hollow beams 77, 78 contoured to provide a form fitting comfortable seat with a longitudinally extending gap therebetween. The lower wall of each beam 77, 88 is constituted of a pair of spaced longitudinal sections 79, 79 terminating along its inner longitudinal edge in a shallow vertical lip 80. In the region of each brace 75, the lips 80, 80 of each seat beam is spanned by a clip 81 which is secured to its associated brace 75 by a bolt 82. A back rest plate 83 is then secured to the post 16 and mullions 22, 23 in any suitable fashion, as by rivets.

Figure 11:
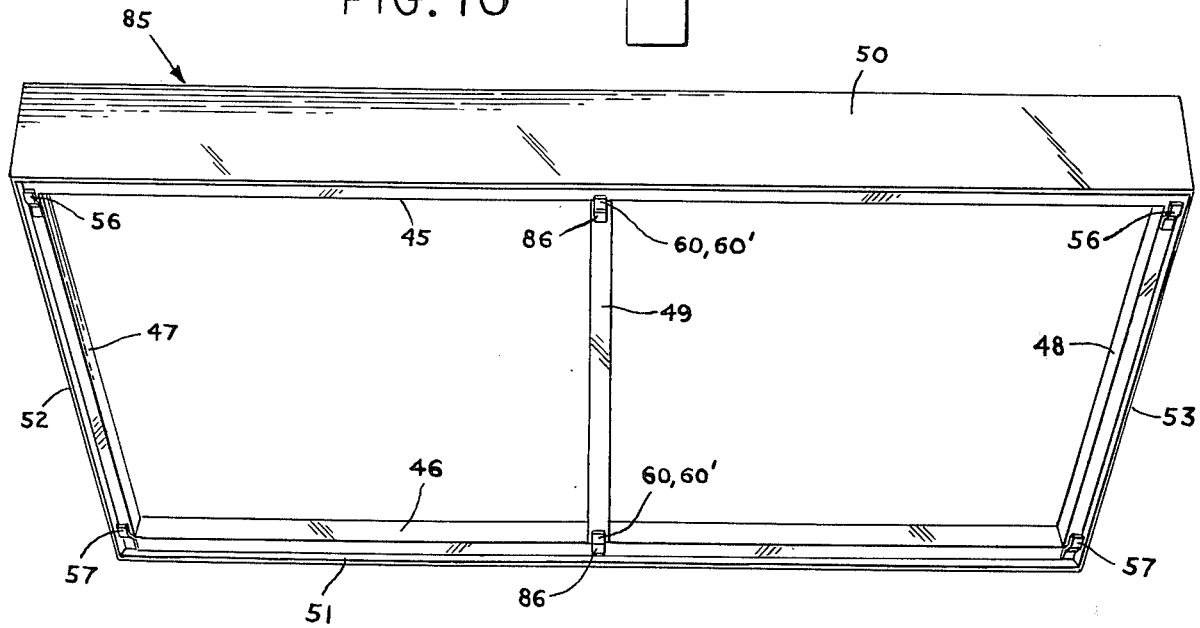
FIG. 11 is an exploded perspective view showing another method of assembling the roof structure on the back and side frames of the shelter.
Figure 11:
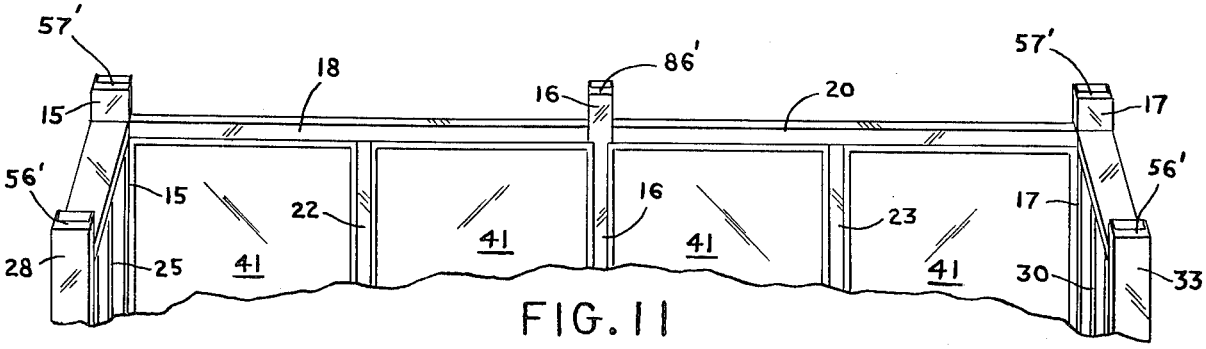

It will be understood that the embodiment of the invention hereinabove described and shown in FIGS. 1–10 of the drawings is by way of example and may be modified and assembled in accordance with different methods as will be apparent to those skilled in the art. Thus, instead of assembling the roof structure 13 step-by-step on the back frame 10 and the side frames 11 and 12, the roof beams 45–49 together with the associated fascia sections 50–53 are first assembled as a rectangular frame 85 (see FIG. 11). In constructing such frame, the beams 45–49 are connected together by interlocking the previously described cooperative pairs of interlatching elements 58–58′, 59–59′ and 60–60′ associated with such beams. When the beams 45–49 constituting the frame 85 are thus assembled, such frame is locked to the upper ends of the posts 15, 17, 28 and 33 by interlatching the catches 56, 56 in the front beam 45 with the latch plates 56′, 56′ in the upper ends of the posts 28 and 33, and by interlatching the catches 57, 57 on the rear beam 46 with the latch plates 57′57′ in the upper ends of the posts 15 and 17. Preferably also a catch 86 is provided centrally on the bottom wall of the rear beam 46 for interlatching engagement with a latch plate 86′ provided wholly within the opening at the top of the post 16. Such a catch 86 and latch plate 86′ are also preferably provided on the rear beam 46 and post 16 when assembling beam 49 in the manner previously described. When the beams 45–49 are initially assembled onto a frame 85 for placement on the posts of the frames 10–12, care should be taken that the catches 56, 57 and 86 are mounted on the beams 45, 46 and 49 so that the plate portions thereof all project in the same direction and that the latch plates 56′, 57′ and 86′ are properly mounted in the tops of the posts, as illustrated in FIG. 11 of the drawings. With the catches and latch plates so arranged the plate portions of the catches may be simultaneously inserted into the tops of the posts as the frame 85 is seated thereon, and the catches and latch plates simultaneously interlatched by sliding the frame in a direction to effect such interlatchment. When the frame 85 is secured in position on the posts 15–17, 28 and 33, the roof bubbles 65, 65′ and the fastening bars 66, 66′, 67 and 67′ are assembled on the frame 85 in the manner previously described.

Figure 12:
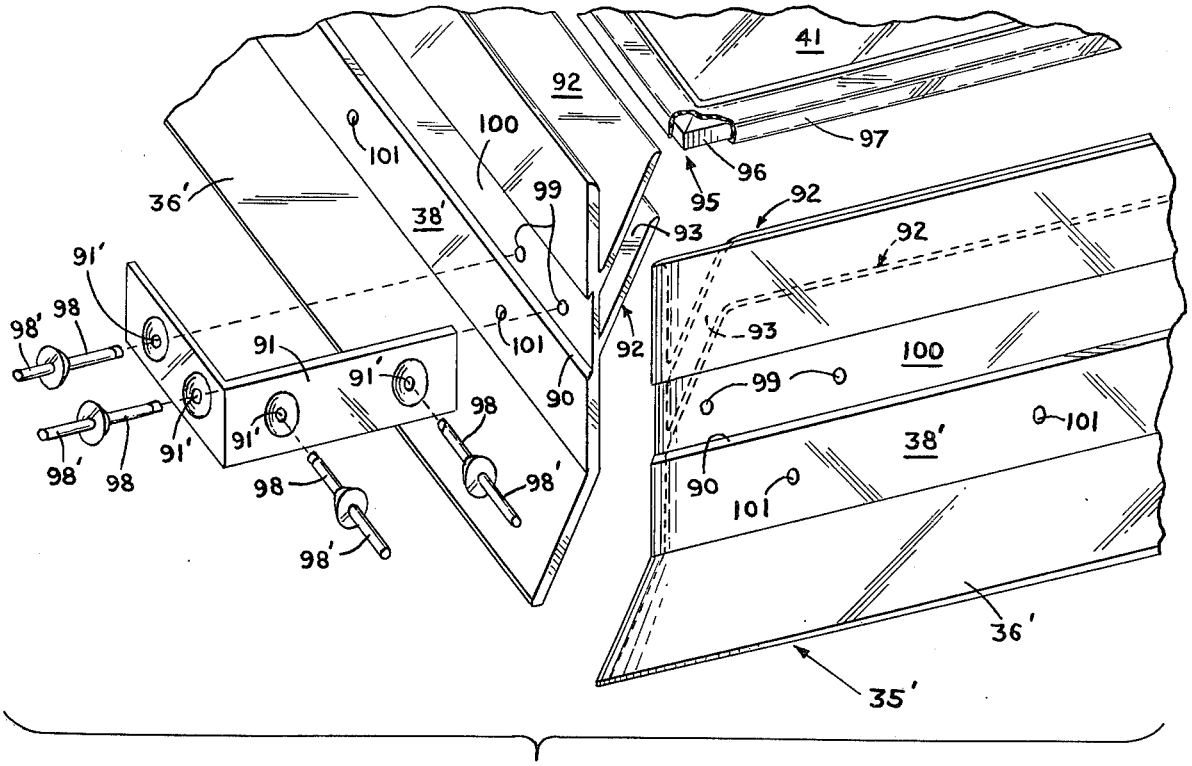
FIG. 12 is an exploded perspective view of a corner portion of a modified form of window unit construction to show the construction of the parts in such unit.
Figure 13:
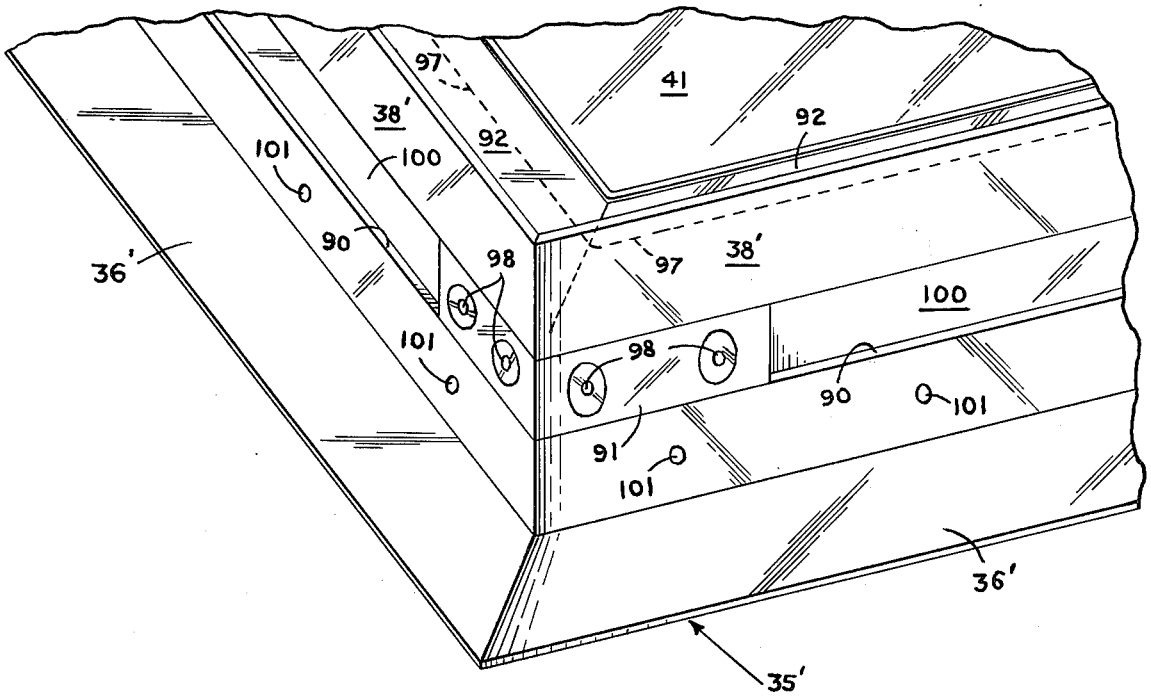
FIG. 13 is a perspective view showing the parts illustrated in FIG. 12, in assembled condition.

Instead of forming the frame of each window unit 35 as a unitary member as previously described, such frame may be formed of four separate side pieces connected together at their ends. A preferred form of window unit constructed in this fashion is shown in FIGS. 12 and 13 of the drawings and generally designated 35′. Window unit 35′ comprises four separate frame side pieces, each composed of a frame section 36′to that overlies the outer side wall of the associated side frame member defining one side of an opening 37 in FIG. 4, and a frame section 38′ which is inserted into the opening 37 and engages the inner side wall of such associated side frame member defining such opening. The exterior surface of each frame section 38′ is provided with a longitudinally extending groove 90, which is aligned with the grooves 90 of adjacent frame sections 38′. Positioned in the ends of each groove 90 are one of the legs of two corner angle irons 91 which connect the ends of each frame side piece to the ends of adjacent frame side pieces. The exterior surfaces of the angle irons 91 are flush with the exterior surfaces of the frame sections 38′ and do not interfere with the insertion of such frame sections of the window unit into an opening 37. Disposed at right angles to each frame section 38′ and projecting inwardly from the central longitudinal portion of the inner wall thereof, are a pair of parallel, spaced flanges 92, 92 forming a slot 93 for receiving one side of a glass unit generally designated 95 in FIG. 12. The ends of the flanges 92, 92 of the frame sections 38′ are mitered to form a closed, continuous slot for the reception of the sides of the glass unit 95. The glass unit 95 comprises a rectangular glass pane 41 enclosed in a rectangular mold 96 of suitable material such as aluminum, and the sides of which are enclosed by resilient tubing 97 made of suitable plastic material and slotted along its inner periphery to receive the mold 96. The inner slotted edges of the tubing 97 are provided with parallel flanges which bear on the edge portions of the glass pane 41. The width of the flanges 92, 92 is greater than the combined width of the window mold 96 and tubing 97 so that the tubing 97 when fully inserted into the slots 93 does not contact the inner ends of such slots. The thickness of the tubing 97 is such that it snugly engages in sealing condition the inner surfaces of the flanges 92, 92. When the window unit is assembled in the window unit the tubing 97 is wholly enclosed by the frame flanges 92 except for the inner flanges of such tubing, as shown in FIG. 13. The glass unit 95 is secured in assembled condition within the window unit 35′ by rivets 98 which secure the angle irons 91 to the frame sections 38′. It will be understood that in the assembly of such parts the rivets 98 will extend through the tapered openings 91′ formed in the angle irons 91, and through the openings 99 formed in the inner walls 100 of the grooves 90. The inner groove walls 100 also form the back walls of the slots 93, thereby permitting the inner ends of the rivets 98 to project into such slots. The rivets 98 are of a type well known in the art and comprise a tubular body through which is inserted a nail-like element 98′ that is connected at its inner end to the tubular body. When a rivet 98 is inserted through openings 91′ and 99 and held in that position while the element 98′ is withdrawn, the inner end of the tubular body of the rivet will be distorted to lock the rivet in position. The rivet element 98′ is wholly removed as shown in FIG. 13. When the parts are thus assembled, the sides of the glass unit 95 will be fixed in proper position within the frame sections 38′. The window unit 35′ is secured in position in an opening 37 by rivets 39, in FIG. 4, in the manner of the window unit 35, there being provided in the frame sections 38′ suitable holes 101 for the insertion of such rivets. It will be observed that since the angle irons 91 will be located between the frame sections 38′ and the interior surfaces of the beams forming the opening 37 when the window unit 35′ is secured in position in the opening, such window unit will be practically tamperproof.

I claim:

1. A waiting station comprising a wall structure constructed of vertical and horizontal members made of tubing of rectangular cross-section and having open ends, and pairs of cooperative interlatching elements connecting said tubular members together, each of said pairs comprising a latch plate and a catch, said latch plate being wholly contained within the opening in an end of one tubular member in transverse relation to the longitudinal axis of such member and so that the outer surface of such plate is flush with the terminal end of the tubular member, said latch plate extending from one side wall of said tubular member and the area of such latch plate being less than the area of said opening so that such opening is only partially closed by such plate to provide a space between one free side of such plate and the side wall of said tubular member opposite said one side wall thereof, and said catch being constituted of a member having one end portion secured to a side wall of a second tubular member intermediate the terminal ends of the latter and having its other end portion spaced from and in substantial parallelism with such surface, said other end portion being disposed in opposed relation to said latch plate and being insertable through said space adjoining the free side of said latch plate, and after being so inserted interlatchable with said latch plate, said latch plate and catch, in interlatched condition, being entirely concealed by the connected end of said one tubular member and said side wall of the second tubular member.

2. A waiting station such as defined in claim 1, in which said wall structure is composed of a plurality of modules, each of said modules comprising two of said tubular members forming vertical columns, two of said tubular members forming an upper and a lower horizontal beam spanning the space between the two columns, and a tubular member forming a vertical mullion located between and spaced from said columns and spanning the space between said horizontal beams, said columns, beams and mullion being connected together by said cooperative interlatching elements to conceal from an observer's view the manner of such connections.

3. A waiting station as defined in claim 2, in which said vertical mullion of each module is connected to the centers of said horizontal beams to form with said beams and columns of each module, two rectangular openings, and including two separate window units filling said two rectangular openings and each having a rectangular frame provided with substantially flat side walls overlying in surface engagement the enclosing side wall portions of the associated beams, columns and mullion, and means securing said side walls of each frame to said enclosing side wall portions, said frames and securing means locking said beams, columns and mullion of each module together.

4. A waiting station as defined in claim 1, including a bench composed of a plurality of brace members connected to the lower portions of a plurality of said vertical tubular members and having horizontally disposed supporting arms, a pair of spaced elongated tubular members extending transversely to and resting on said supporting arms of said brace members to form a seat, said elongated tubular members being split lengthwise on the under brace member engaging walls thereof to provide two spaced longitudinally extending edge portions intermediate the longitudinal sides of each tubular member, and means engageable with said spaced edge portions formed in the under split walls of said elongated tubular members and securing said elongated tubular members to said brace members.

5. A waiting station as defined in claim 1, in which said wall structure is composed of a back wall and two side walls, said back and side walls including upper horizontal members spaced downwardly from the upper ends of and connected in the manner aforesaid to the side walls of vertical members forming columns in said walls so that the upper portions of said vertical column members project above said upper horizontal members, there being at least four vertical column members with upwardly projecting portions located at the ends of said back and side walls, a first pair of spaced horizontal members having their end portions seated on the upper ends of said vertical column projecting portions, latch plates as aforesaid located in the open upper ends of said projecting portions, and catches as aforesaid on the lower side walls of said spaced horizontal members and interlatched as aforesaid with said latch plates, a second pair of spaced horizontal members located between said end portions of said first pair of spaced horizontal members, each of said horizontal members of said second pair having in both open ends thereof latch plates as aforesaid, and catches as aforesaid on the inner vertical side walls of the end portions of said first pair of spaced horizontal members and interlatched as aforesaid with said latch plates in the ends of said second pair of spaced horizontal members, and a roof structure mounted on and supported by said interlatched first and second pairs of spaced horizontal members.

* * * * *